US005425661A

United States Patent [19]

Self, Jr. et al.

[11] Patent Number: 5,425,661

[45] Date of Patent: Jun. 20, 1995

[54] ELECTRICAL CONNECTOR HOUSING WITH IMPROVED CONTACT INSERTION

[75] Inventors: Daines M. Self, Jr., Oak Ridge; Richard D. Hutchinson, Jr., Greensboro; Michael P. Trull, Winston-Salem, all of N.C.

[73] Assignee: The Whitaker Corporation, Wilmington, Del.

[21] Appl. No.: 953,449

[22] Filed: Sep. 29, 1992

[51] Int. Cl.[6] ..... H01R 13/432

[52] U.S. Cl. ..... 439/748

[58] Field of Search ..... 439/246, 746, 733, 682, 439/686, 689, 690, 692, 693, 694, 695, 697, 748, 749, 205, 206

[56] References Cited

U.S. PATENT DOCUMENTS 3,980,385 9/1976 Hirokawa et al. ..... 439/246

4,017,141 4/1977 Bury et al. ..... 439/746

OTHER PUBLICATIONS

AMP Catalog "Mini-Universal Mate-N-Lok Connectors" (82-680) Aug. 1984.

AMP Instruction Sheet—IS 3200 Jan. 10, 1989.

*Primary Examiner*—Gary F. Paumen

*Attorney, Agent, or Firm*—Bruce J. Wolstoncroft

[57] ABSTRACT

An electrical connector (10) having a housing (12) of resilient plastic material of a type molded in a closed mold with bores defined by core pins; the housing including at least a bore (22) extending therealong leading from an insertion segment (36) of a given diameter to receive a contact (12) to a reduced diameter defining a support segment (28) supporting the contact in the housing, and a forward segment (25), with the various segments extending along a common axis (A) and with a beveled transition defined by surfaces (34) extending between the bore of the insertion segment and the bore of the support segment as defined by a series of recesses (30) and segments (32) arranged around the support segment periphery to define a lead-in for the said contact and maintain an approximate constant thickness of material to minimize plastic sinking and distortion.

8 Claims, 4 Drawing Sheets

ELECTRICAL CONNECTOR HOUSING WITH IMPROVED CONTACT INSERTION

FIELD OF THE INVENTION

This invention relates to an electrical connector housing of molded plastic material having a contact receiving bore facilitating contact insertion.

BACKGROUND OF THE INVENTION

A type of electrical connector widely used in interconnecting electrical and electronic devices employs a thermoplastic material sufficiently resilient to incorporate in one piece bores or cavities to receive contacts and hinged elements to facilitate latching and fastening of connector halves together. Such connectors are used in high volume and accordingly, are made in multiple cavity molds with mold cycle times as short as possible, consistent with the material employed and the need for minimizing distortion in dimensions to acceptable tolerances. One of the practices widely utilized in molding such housings is to maintain wall thicknesses throughout the connector relatively constant. By that is meant that wall thicknesses varying much more than 50 percent through any section of the connector between mold surfaces, between an outer mold shell and core pins, may experience not only distortion, but tolerance variations and a visual appearance, which is unacceptable. Longer mold cycles may remedy some of these shortcomings, though not all, and will lead to a substantial increase in cost of housings.

With respect to one widely used type of thermoplastic housing, the interior bore of the housing has been made to include a contact receiving sleeve that forms a bearing segment to support the contact radially within the housing, the sleeve thickness being made along most of its length approximately equal to other wall thicknesses of the housing. This interior sleeve typically includes an inwardly directly beveled or tapered surface that serves to guide contacts during insertion of such contacts within a housing. With respect to male contacts having a rounded forward end, such sleeve works generally adequately without stubbing, but with female contacts that have a blunt or squared end, problems have arisen due to stubbing with the female contact catching on the end of the sleeve if the sleeve is not adequately concentric or if the contacts is not properly lined up. This sort of problem is aggravated by a lack of concentricity of the sleeve caused by high speed mold cycles or variations in plastic material. At one time the contact bearing segment was made solidly, but problems were experienced with a lack of roundness of the bore through the segment causing, on occasion, contact backout due to the lances of the contact becoming aligned with an out of round bore segment.

Another problem associated with housing of the prior art relates to the breakage or elongation of the sleeve due to muscle pulls. After the housing has been molded, the core pin can stick to the material of the sleeve, thereby causing the sleeve to be damaged as the core pin is removed. This is a frequent occurrence as the sleeve is not supported over its entire length. If the sleeve is torn or elongated, the contacts can not be properly seated and locked within the housing.

Accordingly, it is an object of the present invention to provide an improved electrical connector housing that facilitates an easy and reliable insertion of electrical contacts within the housing. It is a further object to provide a molded plastic housing having a beveled entry to facilitate guiding contacts during insertion with minimum distortion caused by unduly thick sections of plastic material surrounding the contact bearing segment. It is still a further object to provide a thermoplastic housing of molded material having a configuration facilitating high speed molding with minimum distortion and minimal muscle pulls.

It is a final object to provide a contact housing that includes interior beveling or tapering to facilitate contact entry and at the same time, a housing geometry facilitating high speed molding with minimum plastic distortion.

SUMMARY OF THE INVENTION

The present invention features an electrical connector housing, typically having a plurality of cavities or contact receiving bores extending therethrough. In accordance with the invention, each bore is made to include an entry segment of a given diameter leading to a contact bearing or support segment of a lesser diameter and a forward segment of a larger diameter than the diameter of the bearing segment that overlies a contact end. There is provided a step extending radially between the contact bearing segment and the forward segment defining a surface receiving the end of one or more lances that preclude contact backout. There is provided a beveled or tapered surface or surfaces leading from the bore entry segment to the contact support segment to receive the end of an inserted contact, particularly the blunt end of a female contact and guide such contact to enter the bore support segment and pass therethrough into the front segment with the contact lance or lances engaging the step to hold the contact within the housing. In accordance with the invention in a preferred embodiment, the guiding surfaces are comprised of a series of beveled surfaces leading from the diameter of the entry segment to the diameter of the bearing segment with a series of recesses extending between discrete surfaces disposed around the periphery of the bores, such recesses extending at least substantially along the length of the bore support segment to maintain a thickness of material in that region that is approximately constant with respect to the thickness of the portions of the housing. The recesses in the present invention are tapered from the entry segment toward the forward segment to facilitate tapered core pins and an easy withdrawal with minimum distortion of the plastic. In this way, the housing is given the tapered interior bore facilitating contact insertion, and at the same time, minimizes bore distortion which could allow contact backout due to a lance aligning itself with the distorted portion of the bore and as well precluding sink marks in the exterior surface of the housing and/or other distortions that are objectionable. The invention also contemplates that the recesses may be formed from the opposite end of that just expressed, namely, leading from the forward end toward the entry end to maintain the wall thickness and still allow a tapered surface leading from the entry end toward the bore support segment.

IN THE DRAWINGS

DETAILED DESCRIPTION OF THE INVENTION

Figure 1:
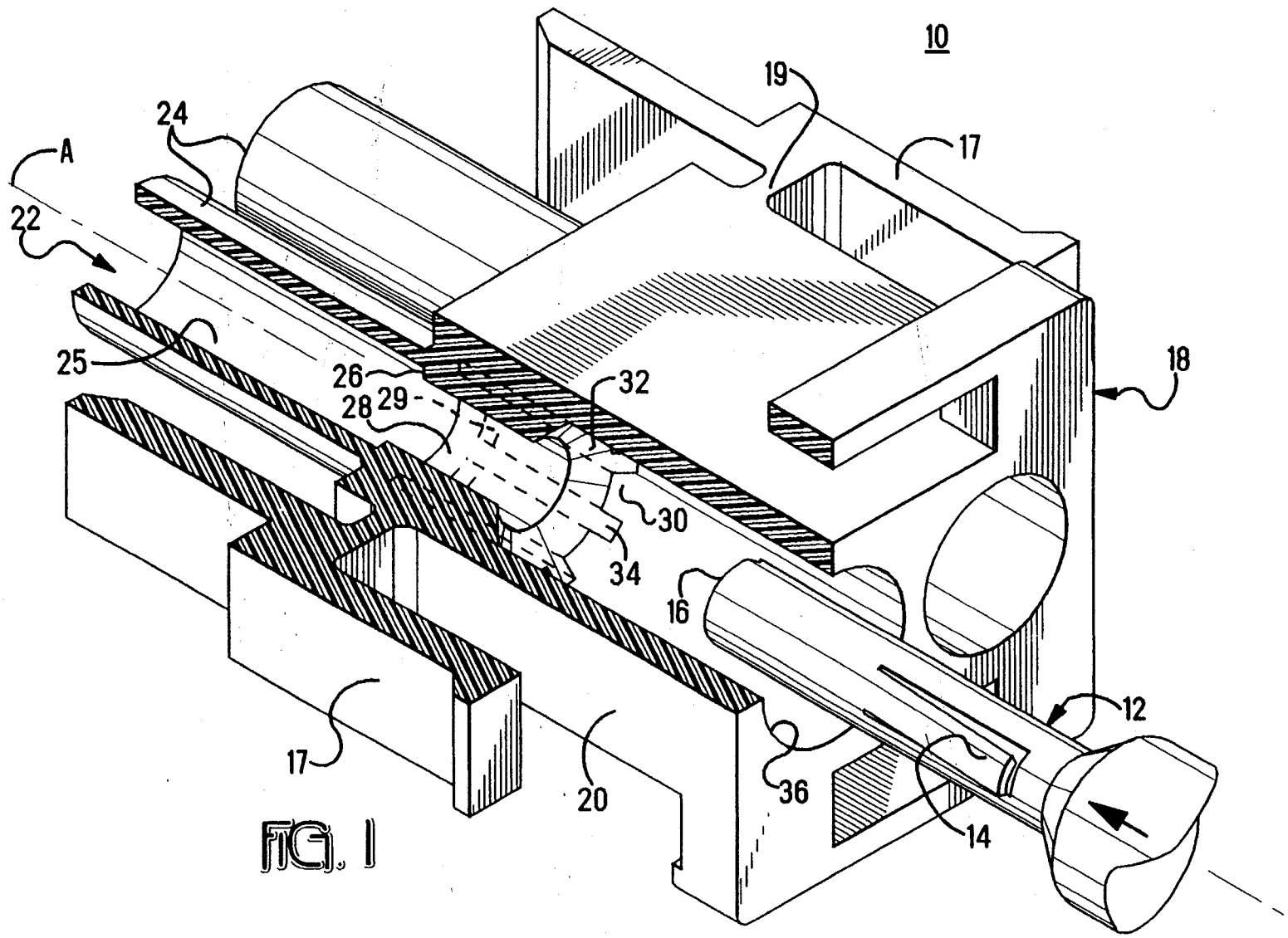
FIG. 1 is a perspective of a connector housing, partially sectioned and showing a contact prior to full insertion within such housing.
Figure 5:
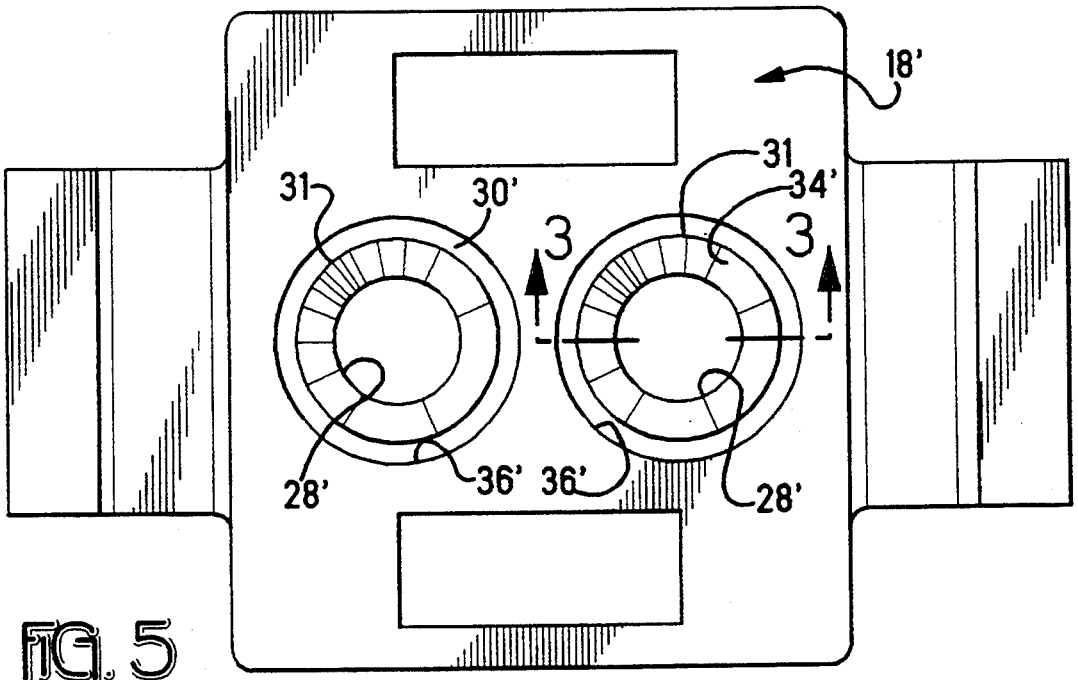
FIG. 5 Prior Art
FIG. 5 is an end view of the housing in accordance with the prior art.
Figure 6:
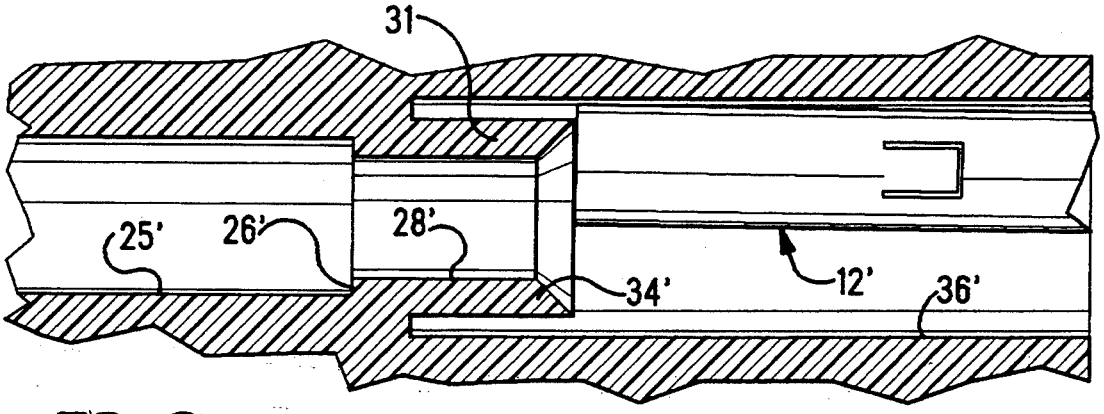
FIG. 6 Prior Art
FIG. 6 is a side and sectional view of a portion of the housing taken along lines 6—6 of FIG. 5.

Referring now to FIG. 1, a connector 10 may be seen to comprise a contact 12 and a housing 18, made from a material such as nylon. The housing 18 receives and supports contact 12 for intermating with a contact in a further connector, not shown, along an axis A. The contact 12, an end portion only being shown, is typically interconnected to a wire that is part of a harness utilized to interconnect electrical or electronic devices. The contact 12 is typically stamped and formed of a spring grade conductive material, such as brass or phosphor bronze, suitably plated, with an alloy of tin or, in certain instances, precious metal. The contact 12 includes at least one lance 14 struck from the outside thereof that is utilized to latch the contact within housing 18. Contacts such as 12 may be either male or female contacts in accordance with widespread usage. Male contacts typically have a rounded end that facilitate insertion into housing such as 18, but female contacts have a blunt or sharp edge leading to an interior receptacle portion into which is plugged a male contact in use. FIGS. 5 and 6 show prior art examples of connectors of the type described. FIG. 5 shows an entry end of a connector housing 18' having an entry bore 36', an interior sleeve 31 having a bevel 34' leading to a contact support bore segment 28'. FIG. 6 shows this in relationship to a forward bore 25' and a step 26' extending between the forward portion 25' and the contact bearing portion 28'. As can be seen, the sleeve 31 extends out into the entry bore segment 36' and as can be seen, a contact 12' being inserted within bore 36' if not properly aligned, may stub on the end of the sleeve 31, despite the beveled surface 34'. The sleeve 31 replaced a prior art solid section in the region of the support segment 28' in order to reduce the distortion of the bore 28' and further distortion in the exterior surface of the housing. The resulting structure, however, has been realized to cause occasional but undesirable stubbing during contact insertion as is depicted in FIG. 6.

Figure 2:
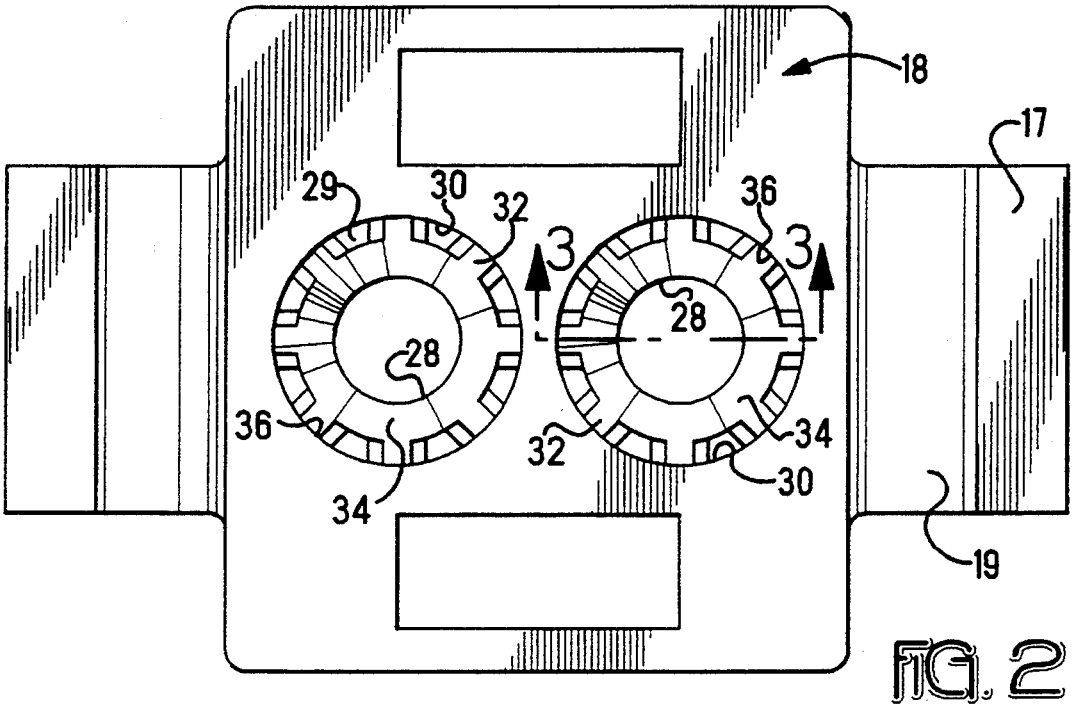
FIG. 2 is a end view from the entry end of the housing shown in FIG. 1.
Figure 3:
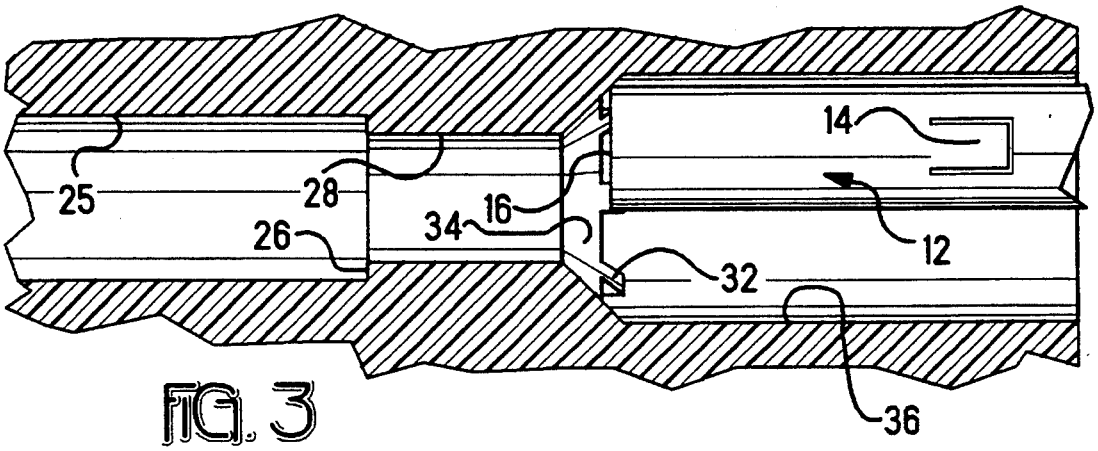
FIG. 3 is a section taken along lines 3—3 of the housing shown in FIG. 2.
Figure 4:
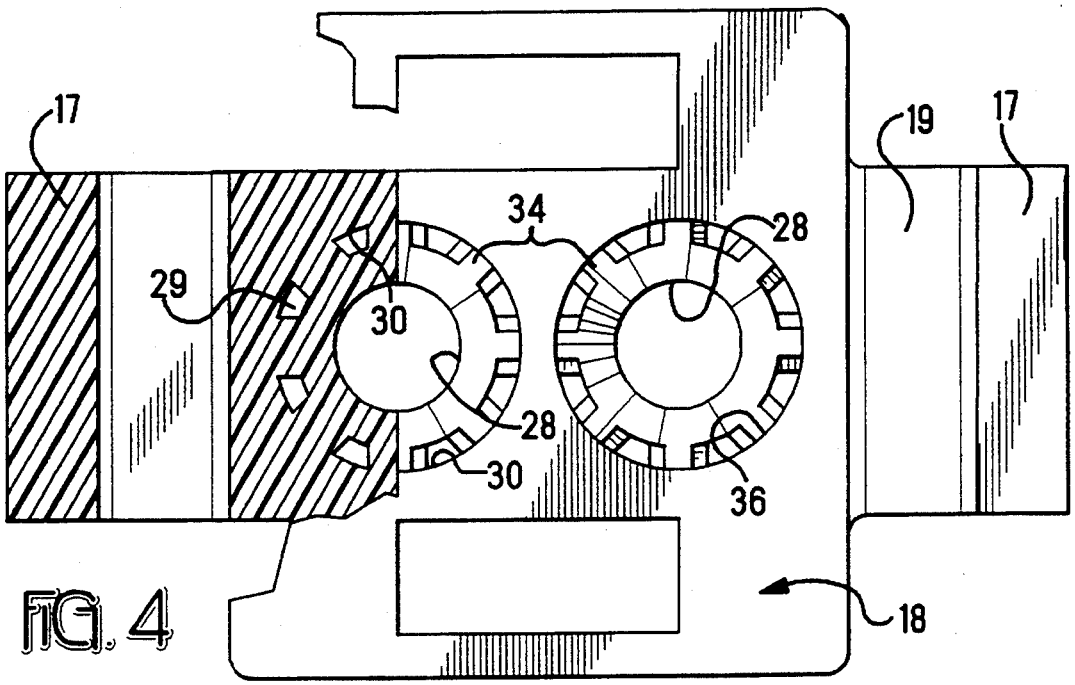
FIG. 4 is a view of the housing from the entry end, partially sectioned, along lines 4—4 of FIG. 1.

The present invention represents an improvement over this prior art through the provision of details to be described. Referring back to FIG. 1, the housing 18 may be seen to include a number of features, such as the hinge shown as 19, allowing the exterior portion of the housing to flex for latching purposes or for engagement purposes. There is a central housing portion 20 that contains a pair of apertures or bores 22 that extend therethrough along an axis of insertion of the contact and of the mating of the connector half and housing 18 with another connector half, not shown. The housing 20 includes forwardly projecting sleeves 24 that have forward bores 25 leading to a step 26 and a contact support segment in bore 28 of a reduced diameter and onto an interior bore 36 that represents an entry segment of the bore 22. The bore 36 is of a substantially larger diameter than bore 28. As can be seen in FIGS. 1 and 2, the bore 28 has a transition to bore 36 in the form of a series of surfaces shown as 34 that are beveled or tapered from bore 28 to bore 36 in the manner shown in FIG. 3. These surfaces 34 are defined by a series of recesses 30 that lead interiorly along the segment of bore 28. The recesses 30 are separated by segments 32 as shown in FIGS. 2 and 3 that extend along the length of segment defined by bore 28 to an end surface 29 as shown in FIGS. 1 and 4. As can be appreciated from FIGS. 1 and 2, the recesses 30 are tapered, narrowing along the length of segment bore 28. FIG. 3 shows the advantage of the configuration to include the tapered or beveled surfaces 34, noting the engagement with end 16 of contact 12 on surface 34 tended to guide the contact insertion into the support bore 28 and on through the housing to a point where the lance 14 of the contact will snap outward to engage the step 26 and lock the contact within bore 22 and to housing 18.

It has been found that providing reliefs and segments with plastic arranged as described and shown in FIGS. 1–4 minimizes distortion of the bore 28, a sinking of material in the exterior of the housing and as well provides a tapered surface leading from bore 36 to bore 28 and easing insertion of contacts. The reliefs and segments also prevent muscle pulls from destroying the integrity of the bore. As the segments are supported over their entire length, the removal of the core pin after molding does not tear or elongate the segments. Consequently, the contacts 12 will be properly seated in the housing.

The invention utilized some eight segments 32 in one embodiment, and the beveled surfaces 34 were tapered relative to the insertion axis a shown in FIG. 3. The invention fully contemplates alternative embodiments as for example where the recesses 30 are made to lead from the bore segment 25, originating at step 26 and leading rearwardly, tapered as previously to accommodate tapered core pins. Alternatively, the recesses 30 could be alternated with every other recess leading from the bore 25 and the opposite recess leading from bore 36.

In both the foregoing embodiments, the tapered surface 34 would be maintained, the point being that balancing wall thickness minimizes bore distortion and plastic surface sinking. The invention contemplates that fewer recesses 30 may be employed and fewer surfaces 34, as long as there is a beveled guide end leading from the bore 36 to bore 28 guiding contact within the housing, and sufficient balance of wall thickness maintained to prevent distortion.

Having now described the invention in terms intended to enable a preferred practice thereof, claims are set forth which define what is deemed inventive.

We claim:

1. An electrical connector housing of plastic material of the type molded through the use of core pins, the housing having at least one bore adapted to receive an electrical contact inserted therein, the bore having a first entry segment of a given diameter into which the contact is initially inserted and a support segment of a lesser diameter adapted to support the contact in said housing, the support segment has an interior sleeve, beveled surfaces lead from said entry segment to said support segment to define a taper to guide the insertion of the contact into the bore and minimize stubbing during insertion, the interior sleeve has an outwardly facing sleeve wall and the first entry segment has an inwardly facing segment wall which is spaced from the sleeve wall, a series of rib segments, separated by recesses, extend between the sleeve wall and the segment wall the ribs cooperate with the interior sleeve to maintain the material thickness of the interior sleeve in the region of said segment approximately constant to preclude bore distortion and surface sinking of said housing.

2. The housing of claim 1 wherein the beveled surfaces are comprised of at least two distinct beveled surfaces disposed oppositely relative to the entry segment of the bore extending around the periphery.

3. The housing of claim 1 wherein the beveled surfaces are comprised of surfaces disposed around the periphery of the entry segment bore and there are a plurality of distinct recesses with each recess disposed along an axis parallel to a longitudinal axis of the bore.

4. The connector of claim 3 wherein the recesses open into the entry segment of the bore.

5. The connector of claim 1 wherein the bore includes a forward segment to receive a contact end with the forward segment joining the support segment and with at least some of the recesses opening from the forward segment.

6. The connector of claim 3 wherein the recesses are tapered along the length of the axis to facilitate core pin withdrawal with minimum housing distortion.

7. An electrical connector housing formed of plastic material of a type molded in a closed mold having core pins to define Anterior bores, said housing including at least one bore adapted to receive an electrical contact inserted therein along a given axis be retained in position by said housing for intermating with a further contact in a further housing, the bore having an entry segment of a given diameter into which the contact is initially inserted and a support segment of a lesser diameter joining the entry segment to support the contact in the housing, the support segment has an interior sleeve which has an outwardly facing sleeve wall and the entry segment has an inwardly facing segment wall which is spaced from the sleeve wall, a series of beveled surfaces extend radially at an angle relative to said axis inwardly between the inwardly facing segment wall of said entry segment and the outwardly facing sleeve wall of the interior sleeve of said support segment to guide the end of a contact into the support segment and minimize contact stubbing, a series of rids and recesses are provided around the periphery of the interior sleeve of said support segment and extend between the sleeve wall and the segment wall and cooperate therewith to maintain a relatively constant wall thickness of the interior sleeve in the region of said segment to preclude distortion and plastic sinking.

8. The housing of claim 7 including a forward bore of a diameter larger than the bore of said support segment with a step interconnecting said support segment to said forward segment adapted to receive a lance of a contact and hold such contact within the said housing.

* * * * *

UNITED STATES PATENT AND TRADEMARK OFFICE

CERTIFICATE OF CORRECTION

PATENT NO. : 5,425,661

DATED : June 20, 1995

INVENTOR(S) : Daines M. Self, Jr.; Richard D. Hutchinson, Jr.; Michael P. Trull

It is certified that error appears in the above-indentified patent and that said Letters Patent is hereby corrected as shown below:

In the Claims:

Claim 7, Column 5, Line 28 - "Anterior" should be --interior--.

Signed and Sealed this

Nineteenth Day of September, 1995

*Attest:*

*Attesting Officer*

Bruce Lehman

BRUCE LEHMAN

*Commissioner of Patents and Trademarks*